United States Patent [19]

Motohashi et al.

[11] Patent Number: 5,048,602

[45] Date of Patent: Sep. 17, 1991

[54] HEAT EXCHANGERS

[75] Inventors: Tutomu Motohashi; Mitsuru Nobusue; Noboru Kodachi; Ryoichi Hoshino; Hironaka Sasaki, all of Oyamashi, Japan

[73] Assignee: Showa Aluminum Kabushiki Kaisha, Osaka, Japan

[21] Appl. No.: 354,884

[22] Filed: May 22, 1989

[51] Int. Cl.[5] ..... F28F 9/12

[52] U.S. Cl. ..... 165/173; 165/153; 29/890.038

[58] Field of Search ..... 29/157.3 C; 228/183; 165/76, 110, 150, 153, 173, 174, 176, 177

[56] References Cited

U.S. PATENT DOCUMENTS

| | | | |
|---|---|---|---|
| 1,438,596 | 12/1922 | Harding | 165/173 X |
| 4,730,669 | 3/1988 | Beasley et al. | 165/151 |
| 4,815,535 | 3/1989 | Hagemeister | 165/173 |

FOREIGN PATENT DOCUMENTS

| | | | |
|---|---|---|---|
| 3015278 | 10/1981 | Fed. Rep. of Germany | 29/157.3 C |

*Primary Examiner*—Martin P. Schwadron
*Assistant Examiner*—Allen J. Flanigan

[57] ABSTRACT

A heat exchanger includes a core and a pair of headers, the core including flat tubes and corrugated fins sandwiched between the tubes, the headers having holes in which the end portions of the tubes are inserted, wherein each tube comprises a stop means for ensuring that an adequate length of the tubes become inserted in the headers.

7 Claims, 3 Drawing Sheets

HEAT EXCHANGERS

BACKGROUND OF THE INVENTION

The present invention relates to a heat exchanger for use as condenser in radiators and car coolers.

It is known in the art to construct a heat exchanger with a core and headers, the core including flat tubes stacked one above another and fins sandwiched between the tubes.

In constructing such heat exchangers, the tubes and fins are assembled into the core, and then the core and the headers are provisionally connected to each other by driving the tube ends into the headers by power such as a pneumatic cylinder or by manual force such as by a hammer. Finally the permanent joint is effected by brazing or any other means among the tubes, fins and headers.

Under this method it is difficult to determine the optimum lengths of the tubes to be inserted in the headers. If the inserted portion of the tube is too short the joint between the headers and the tubes becomes too weak to withstand a long period of use. If the inserted portion is too long, a brazing substance is likely to intrude into the headers, thereby causing a choking problem. To avoid such improper joints between the headers and the tubes, it is necessary to check if the tube ends are adequately inserted into the headers when the headers and the tubes are provisionally assembled. If it is found that the insertion is excessive or short, a correction is necessary. The correction consumes labor and time. In addition, even if the correction is made, the tubes or the headers are likely to dislocate before the permanent brazing is carried out, another correction becomes necessary.

Accordingly, it is an object of the present invention to provide a heat exchanger capable of easy fabrication with the adequate insertion of the tubes in the headers.

Other objects and advantages of the present invention will become more apparent from the following detailed description, when taken in conjunction with the accompanying drawings which show, for the purpose of illustration only, one embodiment in accordance with the present invention.

SUMMARY OF THE INVENTION

According to the present invention, there is provided a heat exchanger including a core and a pair of headers connected to the core, the core including flat tubes and corrugated fins sandwiched between the tubes, the headers having holes in which the end portions of the tubes are inserted, wherein each tube comprises a stop means for ensuring that an adequate length of tube end becomes inserted into the headers.

DETAILED DESCRIPTION OF THE PREFERRED EMBODIMENT

The present invention can be applied to many uses. The illustrated embodiment is an example for use as a heat exchanger in a condenser. The heat exchanger has a plurality of flat tubes 1 stacked one above another, corrugated fins 2 sandwiched between the tubes 1, and a pair of headers 3, 4 connected to the tubes such that cooling medium paths are formed throughout the tubes 1 and the headers 3, 4.

Figure 5:
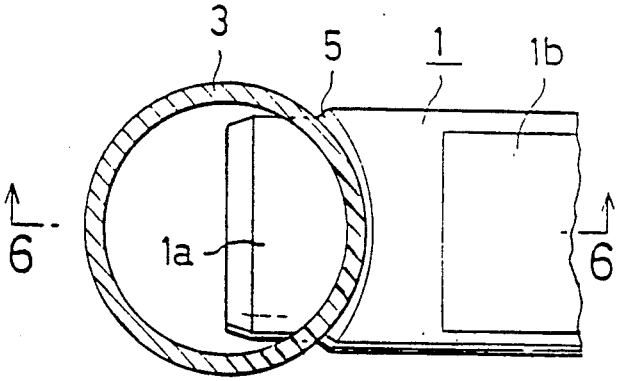
FIG. 5 is a cross-sectional view on an enlarged scale taken along the line V—V of FIG. 2.
Figure 6:
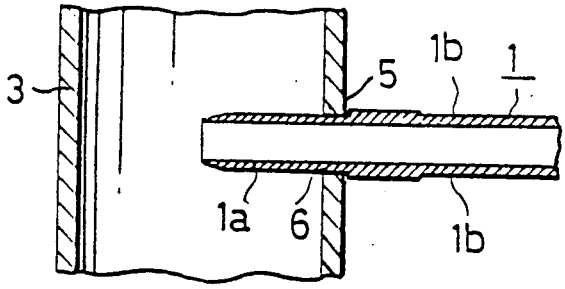
FIG. 6 is a cross-sectional view on an enlarged scale taken along the line VI—VI of FIG. 5.

Each tube 1 is multi-bored, having a flat configuration molded of aluminum by extrusion. The tube 1 has a step 5 formed toward the end portion 1*a* thereof having a smaller thickness than that of the main body. The reference numeral 1 b designates a recess for allowing the fins 2 to stay stably on the body of the tube thereon. The terminating end of each tube 1 is tapered to be smoothly inserted into holes 6 of the headers 3 and 4 as best shown in FIGS. 5 and 6.

Each corrugated fin 2 includes an aluminum core sheet coated with a brazing substance on one surface or both surfaces, having a width identical to that of the tube 1. The fins 2 and the tubes 1 are brazed to each other. Preferably the fins 2 are provided with louvers 2*a* on their surfaces.

Figure 1:
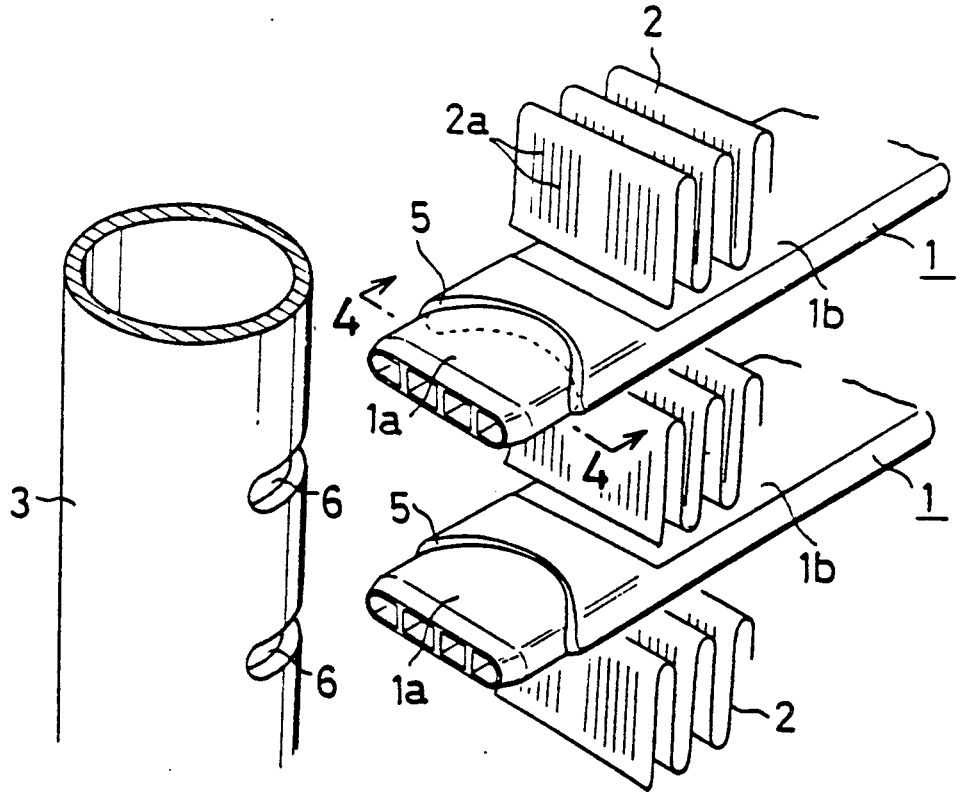
FIG. 1 is an exploded perspective view of a heat exchanger according to the present invention.

The flat tubes 1 are made of electrically seamed pipes coated with a brazing substance. Instead of using the electrically seamed pipes, extruded aluminum pipes can be used. The holes 8 of the headers 3. 4 have the same shape as the cross-section of the tubes 1 so as to accept the end portions 1 a thereof. As shown in FIGS. 5 and 8, the tubes 1 are inserted in the holes 8 until the steps 5 of the tubes 1 come into abutment with the outside of the headers 3, 4, thereby preventing the tubes 1 from inserting deeply in the headers 3 4. The tubes 1 are brazed to the headers 3, 4. The tapered ends of the tubes 1 facilitates the insertion of them into the holes 6 of the headers 3. Preferably, the steps 5 have a semi-circular inner face as shown in FIGS. 1 and 5, thereby ensuring that the semi-circular steps 5 keep contact with the round surfaces of the headers 3, 4. The contact between the header wall and the steps 5 leads to the liquidtight joint between the headers 3, 4 and the tubes 1.

Figure 2:
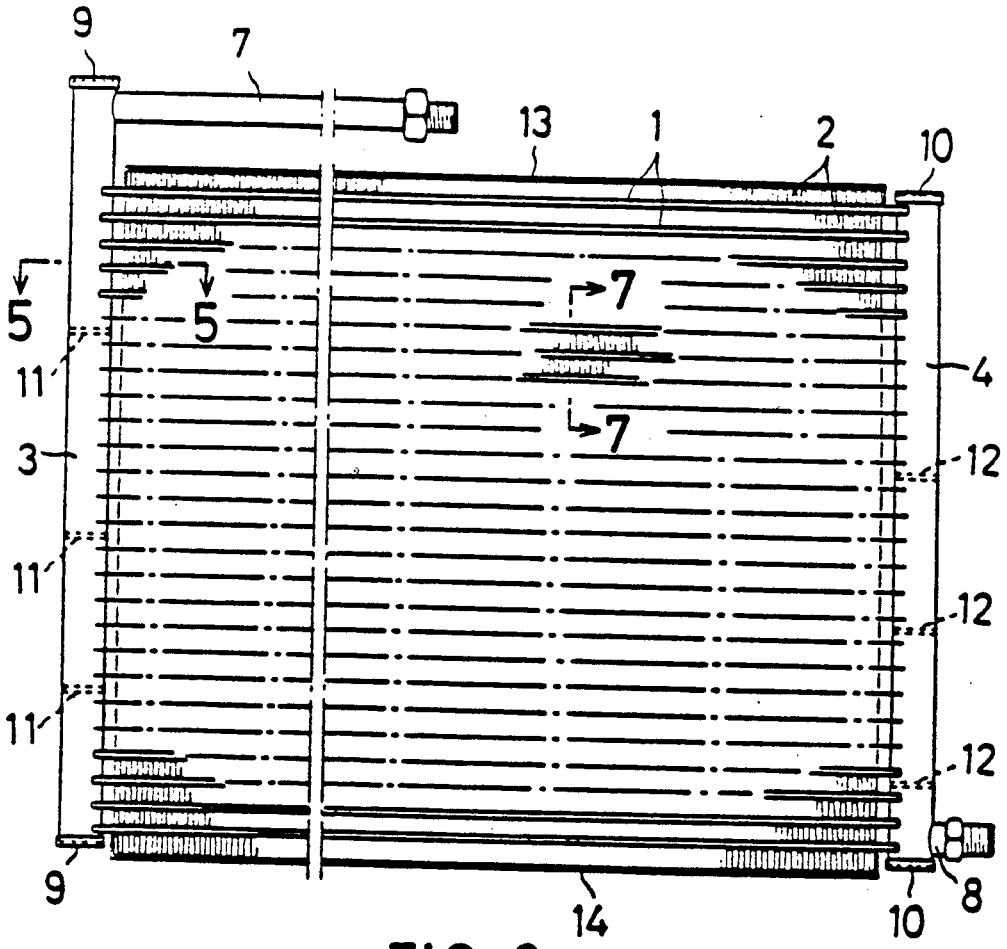
FIG. 2 is a front view showing the heat exchanger.
Figure 3:
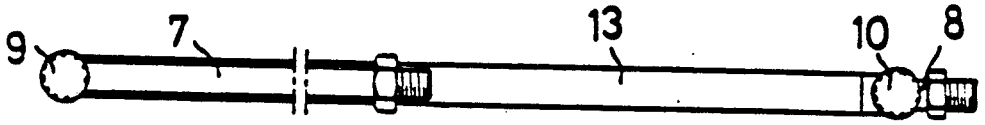
FIG. 3 is a plan view of the heat exchanger.
Figure 4:
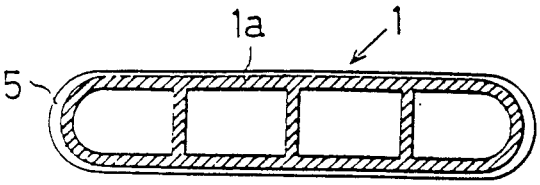
FIG. 4 is is a cross-sectional view on an enlarged scale taken along the line IV—IV of FIG. 1.
Figure 7:
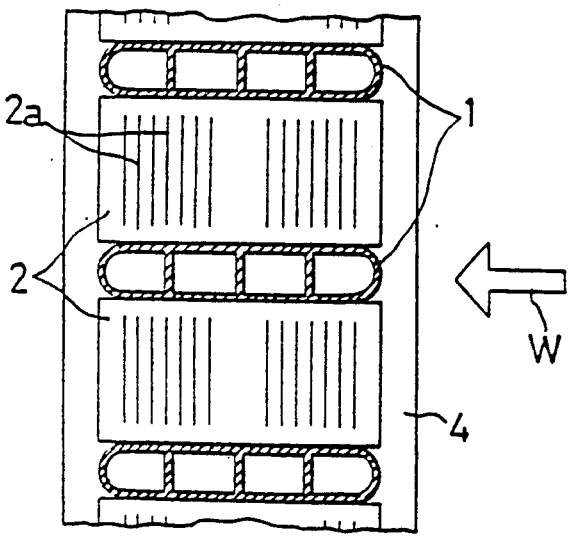
FIG. 7 is a cross-sectional view on an enlarged scale taken along the line VI—VI of FIG. 2.
Figure 6A:
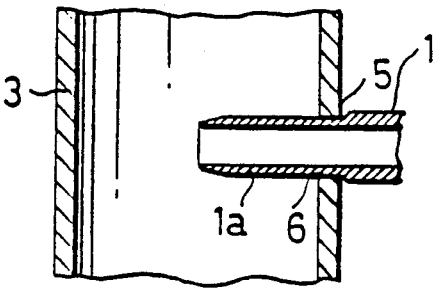

In FIG. 2, the left-hand header 3 is connected to an inlet 7 through which a cooling medium is taken in. and the right-hand header 4 is connected to an outlet 8 through which the used cooling medium is discharged. Each end of the headers 3, 4 is closed by a plug 9, 10. The inner spaces of the headers 3 and 4 are divided into four sections by partitions 11 and 12, respectively. The cooling medium introduced through the inlet 7 flows in a zigzag pattern through the headers and the core, and is discharged through the outlet 8. The partitions 11 and 12 divide the whole cooling medium path into an inlet side group and an outlet side group with an intermediate group therebetween. It is arranged that the effective cross-sectional area of the whole inlet side group of paths progressively diminishes up to the interemediate group which is substantially as high as the middle portion of the headers 3 and 4, and that of the outlet side group of paths is constant from the intermediate group to the outlet. While flowing through the zigzag pattern of paths, the air is cooled by the cooling medium, wherein the air flows in the direction of (W) in FIG. 7.

In FIG. 2 the reference numerals 13 and 14 designate side plates secured to the outermost corrugated fins.

The steps 5 of the tubes 1 are usually formed by a hammer but the working tool is not limited to it. For example, a shaving process or a sizing process can be used. Alternatively, these two processes can be used in combination. In the illustrated embodiment the steps 5 are a continuous semi-circle but on or more projections can be formed on the surface of each tube. In the illustrated embodiment the ends of the tubes 1 are directly inserted in the headers 3, but when the headers 3, 4 are made up of plates and tanks, the tubes 1 are inserted in holes produced in the plates, wherein the steps 5 equally serve as a stop.

Various changes and modifications can be made within the scope and spirit of the present invention.

As is evident from the foregoing description, the steps 5 prevent the ends of the tubes from being inserted too far in to the headers 3, 4. The provision of the steps 5 simplifies the assembling process of tubes and headers. The workers are saved from time and labor which otherwise would be consumed in overseeing the insertion of the tube ends into the headers. Other advantages are that the assembling process can be easily automated because of the elimination of the necessity of visually checking the insertion of the tube ends. The tubes are secured by braxing to the headers without the possibility of dislocation between the tubes and the headers.

What is claimed is:

1. A heat exchanger including a core and a pair of headers connected to the core, the core including flat tubes and fins sandwiched between the tubes, the headers having holes in which the end portions of the tubes are inserted, wherein each tube comprises a stop means for insuring that an adequate length of tube end becomes inserted into the headers, said stop means being formed in the shape of a step whereby the end portions of the tubes have a smaller thickness than the thickness of the main body thereof.

2. A heat exchanger as set forth in claim 1, wherein the stop means is formed around the whole circumference of the tube.

3. A heat exchanger as set forth in claim 1, wherein the stop means has a shape corresponding to that of the holes so as to be complementary with the peripheral surfaces of the headers.

4. A heat exchanger as set forth in claim 1, wherein each tube has a tapered terminating end adapted to be smoothly inserted into the header.

5. A heat exchanger as set forth in claim 1, wherein the headers are made of aluminum having a round cross-section.

6. A heat exchanger as set forth in claim 1, wherein the tubes are made of extruded aluminum having an oval cross-section and a plurality of bores.

7. A heat exchanger including a core and a pair of headers connected to the core, the core including flat tubes and fins sandwiched between the tubes, the headers having holes in which the end portions of the tubes are inserted, wherein each tube comprises a stop means for insuring that an adequate length of tube end becomes inserted into the headers, said stop means being a tapered step formed in the outer surface of each tube whereby the end portions of the tubes have a smaller thickness than the thickness of the main body thereof.

* * * * *